US007635968B2

(12) United States Patent
McDonald et al.

(10) Patent No.: US 7,635,968 B2
(45) Date of Patent: Dec. 22, 2009

(54) TECHNIQUES FOR HANDLING LOW LINE VOLTAGE CONDITIONS IN POWER SUPPLY UNITS

(75) Inventors: Brent A. McDonald, Round Rock, TX (US); Brian P. Johnson, Cedar Park, TX (US)

(73) Assignee: Dell Products, LP, Round Rock, TX (US)

( * ) Notice: Subject to any disclaimer, the term of this patent is extended or adjusted under 35 U.S.C. 154(b) by 380 days.

(21) Appl. No.: 11/626,937

(22) Filed: Jan. 25, 2007

(65) Prior Publication Data

US 2008/0180081 A1 Jul. 31, 2008

(51) Int. Cl.
*G05F 1/613* (2006.01)
*G05F 1/565* (2006.01)

(52) U.S. Cl. ..... 323/222; 323/283; 323/284; 323/285; 323/908

(58) Field of Classification Search ..... 323/222, 323/282–290, 299, 901, 908
See application file for complete search history.

(56) References Cited

U.S. PATENT DOCUMENTS

| | | | | |
|---|---|---|---|---|
| 5,264,782 | A * | 11/1993 | Newton | 323/288 |
| 5,631,550 | A | 5/1997 | Castro et al. | |
| 5,771,168 | A | 6/1998 | Liao et al. | |
| 6,043,633 | A | 3/2000 | Lev et al. | |
| 6,819,089 | B2 | 11/2004 | Deboy et al. | |
| 2005/0269999 | A1 * | 12/2005 | Liu et al. | 323/222 |

* cited by examiner

*Primary Examiner*—Jeffrey L Sterrett
*Assistant Examiner*—Fred E Finch, III
(74) *Attorney, Agent, or Firm*—Larson Newman & Abel, LLP

(57) ABSTRACT

A technique for addressing a low line voltage condition in an information handling system includes determining whether a magnitude of an input voltage of a power supply unit (PSU) is below a first threshold for at least a first time period. The technique also includes adjusting, based on the determining, a magnitude of a reference voltage of the PSU to track a magnitude of an output voltage of the PSU when the input voltage is below the first threshold for at least the first time period.

20 Claims, 5 Drawing Sheets

TECHNIQUES FOR HANDLING LOW LINE VOLTAGE CONDITIONS IN POWER SUPPLY UNITS

FIELD OF THE DISCLOSURE

This disclosure relates generally to information handling systems and, more particularly, to techniques for handling low line voltage conditions in power supply units (PSUs).

BACKGROUND

As the value and use of information continues to increase, individuals and businesses seek additional ways to process and store information. One option is an information handling system. An information handling system generally processes, compiles, stores, and/or communicates information for business, personal, or other purposes. Because technology and information handling needs and requirements can vary between different applications, information handling systems can also vary regarding what information is handled, how the information is handled, how much information is processed, stored, or communicated, and how quickly and efficiently the information can be processed, stored, or communicated. The variations in information handling systems allow for information handling systems to be general or configured for a specific user or specific use such as financial transaction processing, airline reservations, enterprise data storage, or global communications. In addition, information handling systems can include a variety of hardware and software components that can be configured to process, store, and communicate information and can include one or more computer systems, data storage systems, and networking systems.

In any case, information handling systems may include one or more power supply units (PSUs) that are powered from an alternating current (AC) line. In such information handling systems, the PSUs rectify the AC line voltage, e.g., 115 VAC, to provide a direct current (DC) power source that powers one or more subsystems. When the AC voltage level falls below a desired AC voltage level for an extended time period, a brown-out condition is said to occur. When a brown-out condition occurs, a rectified input voltage of a PSU may fall below a desired voltage level. In a conventional PSU, when the input voltage returns to a normal voltage level, the conventional PSU may experience an in-rush current that greatly exceeds an input current experienced under normal operation of the PSU. The in-rush current, which is at least partially attributable to charging of a relatively larger filter capacitor, may causes excessive stress on components of the PSU and lead to reduced component life and/or component failure.

What is needed is a technique for addressing a low line voltage condition in an information handling system that reduces in-rush currents.

BRIEF DESCRIPTION OF THE DRAWINGS

It will be appreciated that for simplicity and clarity of illustration, elements illustrated in the Figures have not necessarily been drawn to scale. For example, the dimensions of some of the elements are exaggerated relative to other elements. Embodiments incorporating teachings of the present disclosure are shown and described with respect to the drawings presented herein, in which.

The use of the same reference symbols in different drawings indicates similar or identical items.

DETAILED DESCRIPTION OF DRAWINGS

Figure 1:
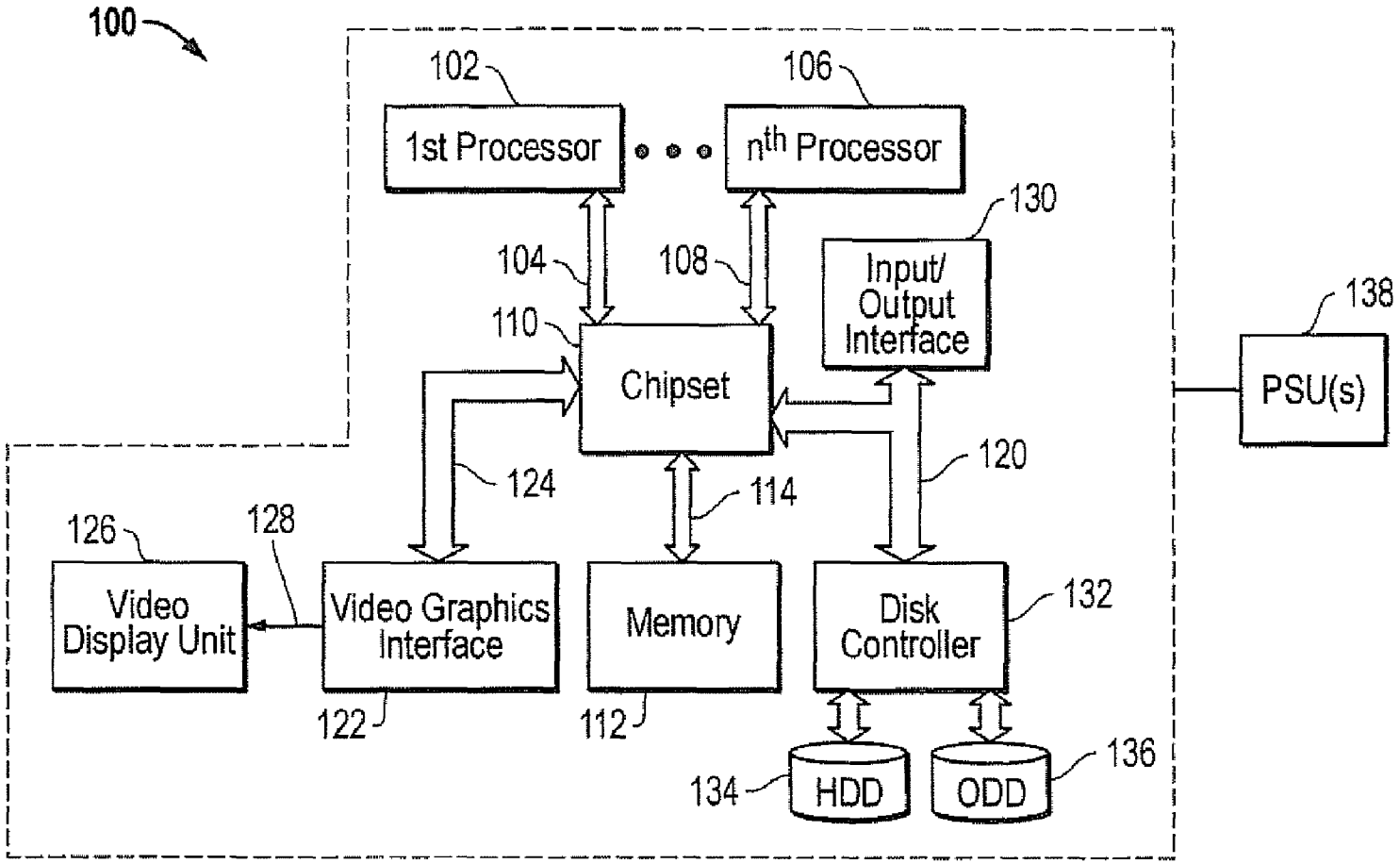
FIG. 1 illustrates a block diagram of an information handling system, according to one aspect of the disclosure.

The following description in combination with the Figures is provided to assist in understanding the teachings disclosed herein. The following discussion focuses on specific implementations and embodiments of the teachings. This focus is provided to assist in describing the teachings and should not be interpreted as a limitation on the scope or applicability of the teachings. For example, much of the following disclosure focuses on information handling systems having power supply units (PSUs) and methods for operating the PSUs to avoid excessive in-rush currents that may damage components of the PSUs. More particularly, the disclosure focuses on a PSU that is implemented as a boost converter, which may operate in a continuous or discontinuous mode. As is well known, a boost convert is a power converter that, in normal operation, provides a direct current (DC) output voltage whose magnitude is greater than a magnitude of a DC input voltage provided by a rectifier circuit of the boost converter. While the disclosed teachings can certainly be utilized in this application, it is contemplated that the disclosed teachings can also be utilized in other power converter applications and with several different types of architectures such as distributed computing architectures, client/server architectures, or middleware server architectures and associated components. As used herein, the term "coupled" includes both a direct electrical connection between elements or blocks and an indirect electrical connection provided by intervening elements or blocks.

For purposes of this disclosure, an information handling system can include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, an information handling system can be a personal computer, a personal digital assistant (PDA) a consumer electronic device, a network server or storage device, a switch, a router, a wireless router, or other network communication device, or any other suitable device and can vary in size, shape, performance, functionality, and price. The information handling system can include memory, one or more processing resources such as a central processing unit (CPU) or hardware or software control logic. Additional components of the information handling system can include one or more storage devices, one or more communications ports for communicating with external devices as well as various input and output (I/O) devices, such as a keyboard, a mouse, and a video display. The information handling system can also include one or more buses operable to transmit communications between the various hardware components.

According to one aspect of the disclosure, a method for addressing a low line voltage condition in an information handling system is disclosed. The method includes determining whether a magnitude of an input voltage of a power supply unit (PSU) is below a first threshold for at least a first time period. The method also includes adjusting, based on the determining, a magnitude of a reference voltage of the PSU to track a magnitude of an output voltage of the PSU, when the input voltage is below the first threshold for at least the first time period.

According to a further aspect of the disclosure, a power supply unit (PSU) for an information handling system includes a rectifier circuit and a control unit. The rectifier circuit is configured to be coupled to an alternating current power source and to provide an input voltage based on the alternating current power source. The control unit is configured to determine whether a magnitude of the input voltage is below a first threshold for at least a first time period. The control unit is also configured to adjust a magnitude of a reference voltage of the power supply unit to track a magnitude of an output voltage of the PSU, when the input voltage is below the first threshold for at least the first time period.

According to a particular embodiment of the disclosure, an information handling system includes a power supply unit (P SU) and an information handling subsystem. The PSU includes a rectifier circuit and a control unit. The rectifier circuit is configured to be coupled to an alternating current power source and is also configured to provide an input voltage based on the alternating current power source. The control unit is configured to determine whether a magnitude of the input voltage is below a first threshold for at least a first time period. The control unit is further configured to adjust a magnitude of a reference voltage of the power supply unit to track a magnitude of an output voltage of the PSU, when the input voltage is below the first threshold for at least the first time period. The information handling subsystem (e.g., a motherboard including at least one central processing unit (CPU), a disk controller, etc.) is coupled to and configured to receive power from the PSU.

FIG. 1 illustrates a block diagram of an exemplary embodiment of an information handling system, generally designated at 100. In one form, the information handling system 100 can be a computer system, such as a server. As shown in FIG. 1, the information handling system 100 can include a first physical processor 102 coupled to a first host bus 104 and can further include additional processors generally designated as $n^{th}$ physical processor 106 coupled to a second host bus 108. The first physical processor 102 can be coupled to a chipset 110 via the first host bus 104. Further, the $n^{th}$ physical processor 106 can be coupled to the chipset 110 via the second host bus 108. The chipset 110 can support multiple processors and can allow for simultaneous processing of multiple processors and support the exchange of information within information handling system 100 during multiple processing operations.

According to one aspect, the chipset 110 can be referred to as a memory hub or a memory controller. For example, the chipset 110 can include an Accelerated Hub Architecture (AHA) that uses a dedicated bus to transfer data between the first physical processor 102 and the $n^{th}$ physical processor 106. For example, the chipset 110 including an AHA enabled-chipset can include a memory controller hub and an input/output (I/O) controller hub. As a memory controller hub, the chipset 110 can function to provide access to the first physical processor 102 using first bus 104 and the nth physical processor 106 using the second host bus 108. The chipset 110 can also provide a memory interface for accessing memory 112 using a third host bus 114. In a particular embodiment, the host buses 104, 108, and 114 can be individual buses or part of the same bus. The chipset 110 can also provide bus control and can handle transfers between the host buses 104, 108, and 114.

According to another aspect, the chipset 110 can be generally considered an application specific chipset that provides connectivity to various buses, and integrates other system functions. For example, the chipset 110 can be provided using an Intel® Hub Architecture (IHA) chipset that can also include two parts, a Graphics and AGP Memory Controller Hub (GMCH) and an I/O Controller Hub (ICH). For example, an Intel 820E, an 815E chipset, or any combination thereof, available from the Intel Corporation of Santa Clara, Calif., can provide at least a portion of the chipset 110. The chipset 110 can also be packaged as an application specific integrated circuit (ASIC).

The information handling system 100 can also include a video graphics interface 122 that can be coupled to the chipset 110 using a fourth host bus 124. In one form, the video graphics interface 122 can be an Accelerated Graphics Port (AGP) interface to display content within a video display unit 126. Other graphics interfaces may also be used. The video graphics interface 122 can provide a video display output 128 to the video display unit 126. The video display unit 126 can include one or more types of video displays such as a flat panel display (FPD) or other type of display device.

The information handling system 100 can also include an input/output interface 130 that can be connected, via a fifth host bus 120, to the chipset 110. The input/output interface 130 can include industry standard buses or proprietary buses and respective interfaces or controllers. The fifth host bus 120 can also include a Peripheral Component Interconnect (PCI) bus or a high speed PCI-Express bus. In one embodiment, a PCI bus can be operated at approximately 66 MHz and a PCI-Express bus can be operated at approximately 128 Mhz. PCI buses and PCI-Express buses can be provided to comply with industry standards for connecting and communicating between various PCI-enabled hardware devices. Other buses can also be provided in association with, or independent of, the fifth host bus 120 including other industry standard buses or proprietary buses, such as Industry Standard Architecture (ISA), Small Computer System Interface (SCSI), Inter-Integrated Circuit (12C), Serial Peripheral Interconnect (SPI), or Universal Serial Bus USB) buses.

In an alternate embodiment, the chipset 110 can be a chipset employing a Northbridge/Southbridge chipset configuration (not illustrated). For example, a Northbridge portion of the chipset 110 can communicate with the first physical processor 102 and can control interaction with the memory 112, the fifth host bus 120 operable as a PCI bus, and activities for the video graphics interface 122. The Northbridge portion can also communicate with the first physical processor 102 using first bus 104 and the $n^{th}$ physical processor 106 using the second bus 108. The chipset 110 can also include a Southbridge portion (not illustrated) of the chipset 110 and can handle input/output (I/O) functions of the chipset 110. The Southbridge portion can manage the basic forms of I/O such as Universal Serial Bus (USB), serial I/O, audio outputs, Integrated Drive Electronics (IDE), and Industry Standard Architecture (ISA) I/O for the information handling system 100.

The information handling system 100 can further include a disk controller 132 coupled to the fifth host bus 120. The disk controller 132 can be used to connect one or more disk drives such as a hard disk drive (HDD) 134 and an optical disk drive (ODD) 136 such as a Read/Write Compact Disk (R/W-CD), a Read/Write Digital Video Disk (R/W-DVD), a Read/Write mini Digital Video Disk (R/W mini-DVD), or other type of optical disk drive. The information handling system 100 includes one or more power supply units (PSUs) 138 configured according to various aspects of the present disclosure to supply direct current (DC) power to information handling subsystems.

Figure 2:
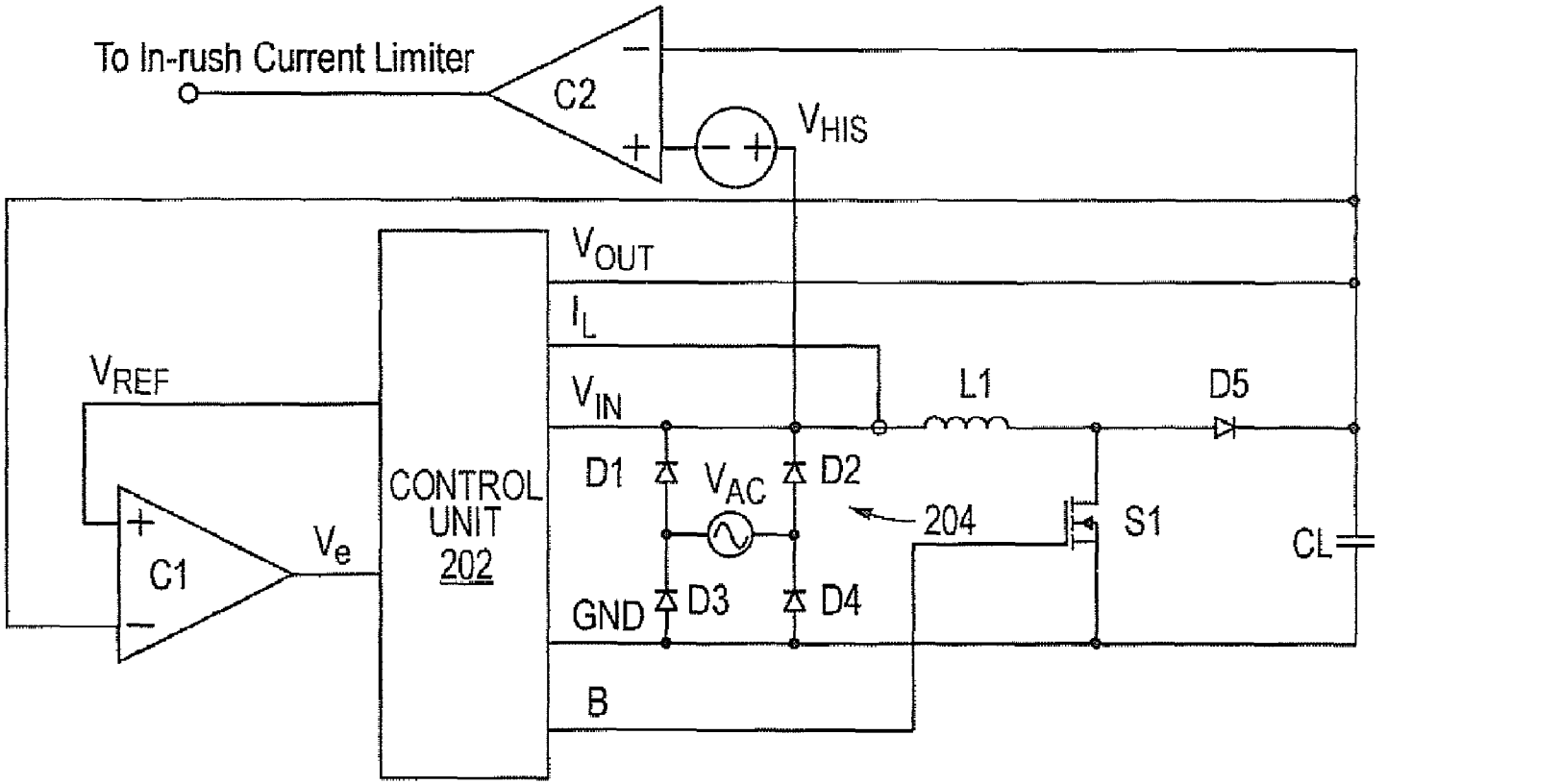
FIG. 2 is a functional block diagram of a power supply unit (PSU), according to another aspect of the disclosure.

FIG. 2 illustrates an electrical diagram, in block and schematic form, of one embodiment of power supply unit (PSU) 138. As is shown, the PSU 138 includes a control unit 202, which may be, for example, a microcontroller, a general purpose processor, a programmable gate array (PGA), an application specific integrated circuit (ASIC), etc. The control unit 202 is programmed to monitor an input voltage $V_{IN}$ provided by rectifier circuit 204, which includes diodes D1, D2, D3, and D4. Inputs of the rectifier circuit 204 are connected to respective outputs of an alternating current (AC) power source $V_{AC}$ and a first output of the rectifier circuit 204 is connected to a first terminal of an inductor L1 and a second output of the rectifier circuit 204 is connected to a common point GND, which may be ground. A second terminal of the inductor L1 is connected to a first terminal of boost switch S1 and an anode of diode D5, whose cathode is connected to a first terminal of a filter capacitor CL. The boost switch S1 may be, for example, a metal-oxide semiconductor field-effect transistor (MOSFET), an insulated gate bipolar transistor (IGBT), a bipolar junction transistor (BJT) or a non-transistor based switch.

A second terminal of the capacitor CL and a second terminal of the boost switch S1 are connected to the common point GND. The control unit 202 also monitors a load current $I_L$ and an output voltage $V_{OUT}$. The control unit 202 also provides a control signal B to a control terminal of the boost switch S1 to control a level of the output voltage $V_{OUT}$ provided by the PSU 138. A duty cycle of the control signal B determines the amount of boost provided by the PSU 138. The control unit 202 provides a reference signal $V_{REF}$ to a first input of a comparator C1, whose second input monitors the output voltage $V_{OUT}$ and whose output provides an error signal $V_e$ that is monitored by the control unit 202. During operation, the control unit 202 controls the control signal B based on the error signal $V_e$. A comparator C2 includes a first input that monitors the output voltage $V_{OUT}$ and a second input that monitors the input voltage $V_{IN}$. More specifically, the second input of the comparator C2 is serially connected to the input voltage $V_{IN}$ through a bias voltage $V_{HIS}$, whose value determines how much above the level of the output voltage $V_{OUT}$ the input voltage ($V_{IN}$) can be before current limiting is employed.

Figure 3:
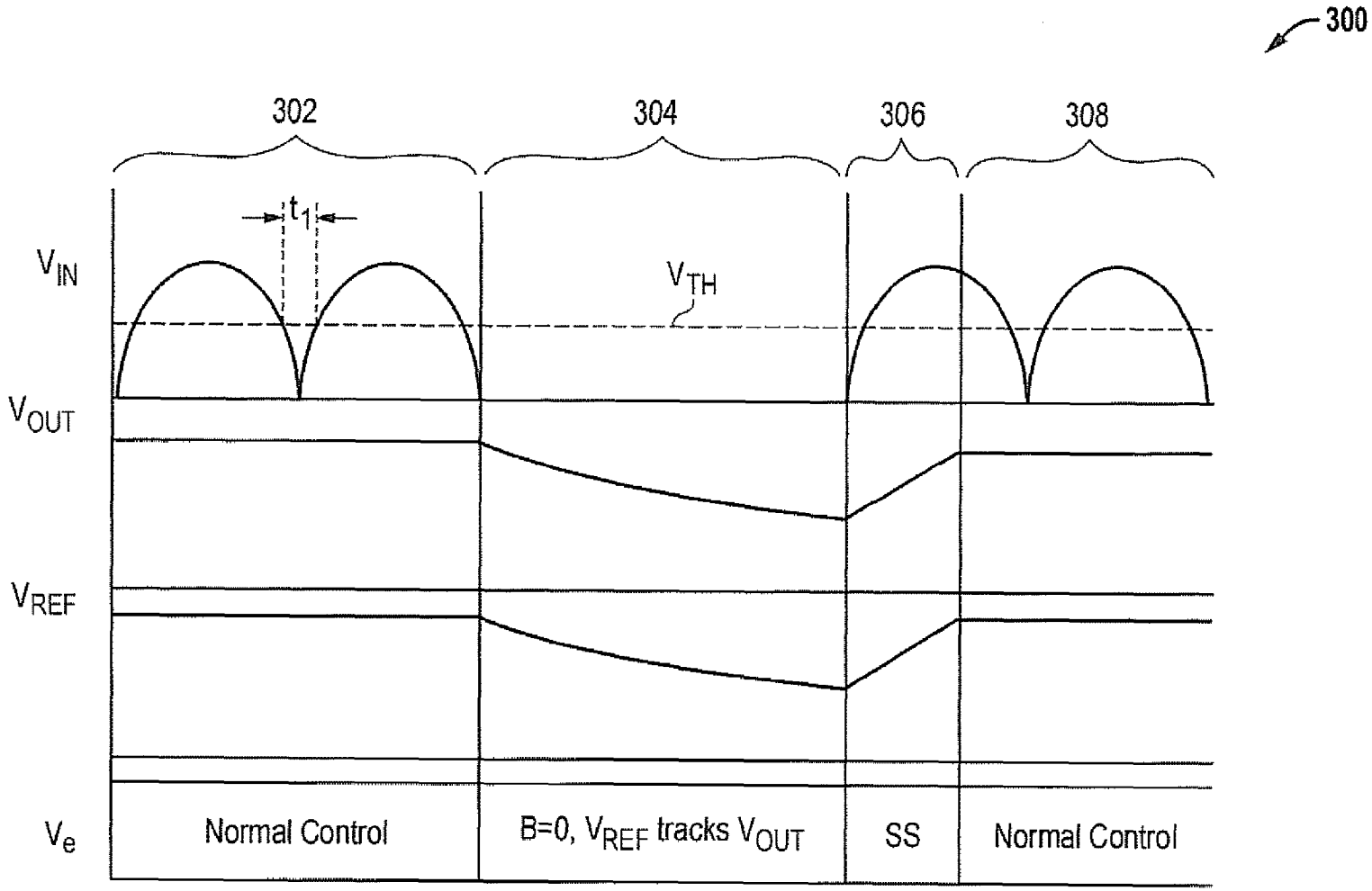
FIG. 3 is a signal diagram that is useful for explaining the operation of the PSU of FIG. 2.

FIG. 3 illustrates a signal diagram 300 that depicts an embodiment of the operation of the PSU 138 prior to, during, and following a brown-out condition. During time period 302, the PSU 138 is operating normally and providing a desired input voltage $V_{IN}$, as the input voltage $V_{IN}$ is not below a desired voltage level $V_{TH}$ for a time period greater than a time period tmax, i.e., $t_1$<tmax. During a next time period 304, a brown-out condition has occurred and the control unit 202 controls the boost switch S1 to enter or remain in a high impedance state by deasserting the control signal B. During the time period 304, the control unit 202 also causes the reference signal $V_{REF}$ to track the output signal $V_{OUT}$. Following the period 304, during time period 306, the input voltage $V_{IN}$ has returned (i.e., the brown-out condition has ended) and the control unit 202 initiates a soft start by causing the reference voltage $V_{REF}$ to continue tracking the output voltage $V_{OUT}$, as the output voltage $V_{OUT}$ increases in response to the input voltage $V_{IN}$. In this manner, in-rush currents can be controlled to prevent or reduce component stress dues to over-currents. At a beginning of time period 308 the output voltage $V_{OUT}$ has reached a desired level and the control unit 202 resumes normal control.

Figure 4:
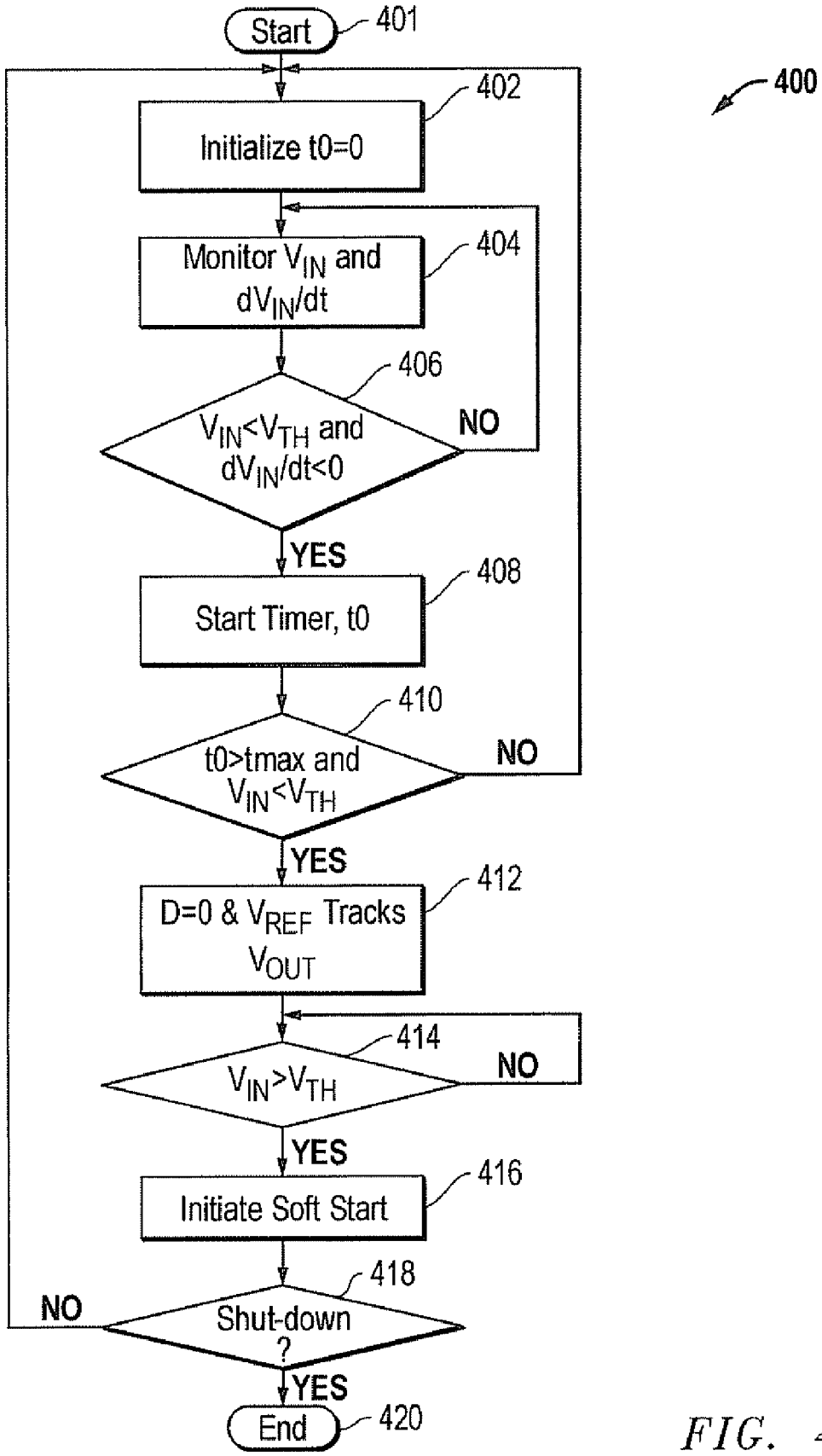
FIG. 4 is a flow diagram of a routine that executes on a control unit of the PSU of FIG. 2, according to one aspect of the disclosure.

Turning to FIG. 4, a process 400 for initiating a soft start of the PSU 138 is depicted in accordance with an embodiment. In block 401 the process 400 is initiated at which point control transfers to block 402, where the control unit 202 initializes a timer t0. Next, in block 404, the control unit 202 monitors the input voltage $V_{IN}$ and a change in input voltage $V_{IN}$ over time (i.e., $dV_{IN}/dt$). Then, in decision block 406, the control unit 202 determines whether the input voltage $V_{IN}$ is less than a threshold voltage $V_{TH}$ and whether a change in the input voltage $V_{IN}$ is less than zero, i.e., negative. If so, control transfers to block 408, where the timer t0 is started. Otherwise, control transfers from block 406 to block 404. It should be appreciated that the timer t0 may be started solely based on a magnitude of the input voltage $V_{IN}$. Following block 408, control transfers to decision block 410, where the control unit 202 determines whether the input voltage $V_{IN}$ has remained below the threshold $V_{IN}$ for a time period that exceeds a desired value, tmax, i.e., whether the timer t0 has exceeded tmax. If so, a brown-out condition is indicated and control transfers to block 412. Otherwise, control transfers from block 410 to block 402.

In block 412, the control unit 202 deasserts the control signal B on the control terminal of the boost switch S1, causing the boost switch S1 to enter or remain in a high impedance state. The control unit 202 also causes the reference voltage $V_{REF}$ to track the output voltage $V_{OUT}$. Next, in decision block 414, the control unit 202 determines whether the input voltage $V_{IN}$ is greater than the threshold voltage $V_{TH}$, i.e., whether the brown-out condition is no longer indicated. If the brown-out condition is no longer indicated in block 414, control transfers to block 416, where the control unit 202 initiates a soft start of the PSU 138. In block 414, when the input voltage $V_{IN}$ is not greater than the threshold voltage $V_{TH}$, control loops on block 414. Following block 416, control transfers to decision block 418 where the control unit 202 determines whether shut-down of the PSU 138 is indicated. When shut-down is indicated in block 418, shut-down is initiated and control transfers to block 420, where the process 400 ends. When shut-down is not indicated in block 418, control transfers to block 402.

Figure 5:
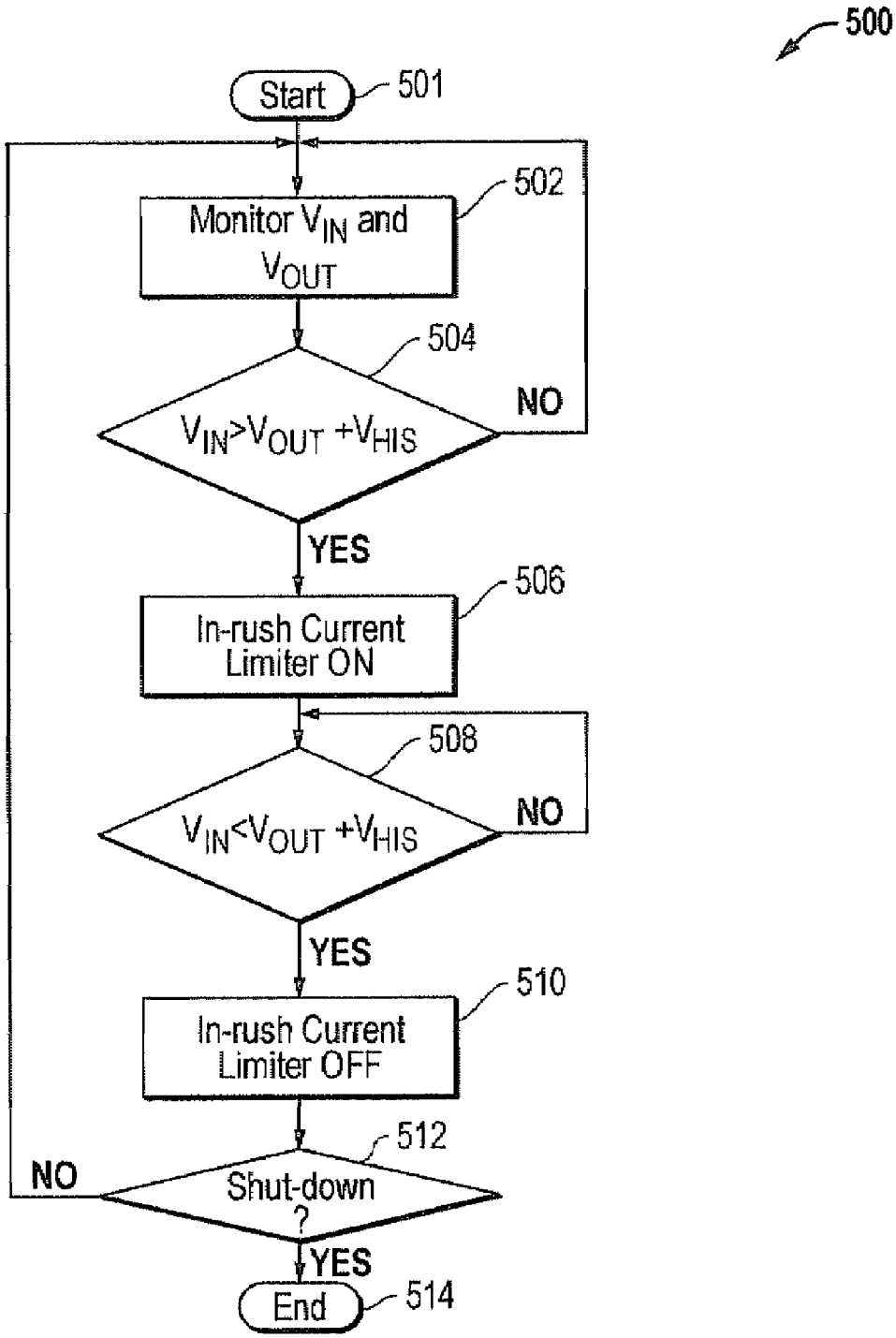
FIG. 5 is a flow diagram of another process that is implemented within the PSU of FIG. 2, according to another aspect of the disclosure.

Moving to FIG. 5, an in-rush current limiting process 500 is depicted that may be performed by the comparator C2 in accordance with one embodiment. It should, however, be appreciated that the process 500 may also be performed by another device, such as the control unit 202. The process 500 is initiated in block 501 at which point control transfers to block 502, where the input voltage $V_{IN}$ and the output voltage $V_{OUT}$ are monitored. Next, in decision block 504, a comparison is performed to determine whether the input voltage $V_{IN}$ is greater than the output voltage $V_{OUT}$ by another voltage, such as hysteresis voltage $V_{HIS}$, which is set large enough to prevent undesirable switching between in-rush current limiting modes (i.e., in-rush current limiting 'on' and in-rush current limiting 'off'). If the input voltage $V_{IN}$ exceeds the sum of the output voltage $V_{OUT}$ and the hysteresis voltage $V_{HIS}$, control transfers to block 506 where in-rush limiting is turned on. Otherwise, control transfers from block 504 to block 502. Following block 506, control transfers to decision block 508, where a comparison is performed to determine whether the input voltage $V_{IN}$ is less than the sum of the output voltage $V_{OUT}$ and the hysteresis voltage $V_{HIS}$. If the input voltage $V_{IN}$ is less than the sum of the output voltage $V_{OUT}$ and the hysteresis voltage $V_{HIS}$ in block 508, control transfers to block 510 where in rush current limiting is turned off. If the input voltage $V_{IN}$ is not less than the sum of the output voltage $V_{OUT}$ and the hysteresis voltage $V_{HIS}$ in block 508, control loops on block 508. Following block 510, control transfers to decision block 512 where a determination is made as to whether shut-down of the PSU 138 is indicated. If shut-down of the PSU 138 is indicated in block 512, control transfers to block 514 where process 500 ends. If shut-down of the PSU 138 is not indicated in block 512, control transfers to block 502.

Although only a few exemplary embodiments have been described in detail above, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims. In the claims, means-plus-function clauses (if utilized) are intended to cover the structures described herein as performing the recited function and not only structural equivalents, but also equivalent structures.

What is claimed is:

1. A method of addressing a low line voltage condition in an information handling system, comprising:

monitoring a magnitude of an input voltage to a power supply unit;

determining a rate of change of the input voltage;

starting a timer when the magnitude of the input voltage drops below a first threshold and when the rate of change of the input voltage is negative;

determining whether the magnitude of the input voltage of the power supply unit is below the first threshold for at least a first time period; and adjusting, based on the determining, a magnitude of a reference voltage of the power supply unit to track a magnitude of an output voltage of the power supply unit when the input voltage is below the first threshold for at least the first time period.

2. The method of claim 1, wherein the adjusting further comprises:

sampling the output voltage; and programming, based on the sampling, the magnitude of the reference voltage to a substantially similar value as the magnitude of the output voltage.

3. The method of claim 1, wherein the power supply unit includes a boost converter and the method further comprises:

causing a boost switch of the boost converter to enter or remain in a high impedance state when a value of the timer exceeds the first time period and the magnitude of the input voltage remains below the first threshold.

4. The method of claim 1, further comprising:

determining whether the magnitude of the input voltage is greater than the magnitude of the output voltage by at least a second value; and limiting a current of the power supply unit while the magnitude of the input voltage exceeds the magnitude of the output voltage by at least the second value.

5. The method of claim 4, further comprising:

discontinuing the limiting of the current when the magnitude of the input voltage does not exceed the magnitude of the output voltage by at least the second value.

6. The method of claim 1, wherein the power supply unit includes a boost converter and the method further comprises:

determining whether the magnitude of the input voltage exceeds the first threshold following the first time period; and controlling a boost switch of the boost converter to increase the output voltage at a desired rate when the magnitude of the input voltage exceeds the first threshold following the first time period.

7. The method of claim 1, wherein the power supply unit includes a boost converter and the method further comprises:

comparing the magnitude of the reference voltage with the magnitude of the output voltage to provide an error signal; and controlling a duty cycle of a boost switch of the boost converter based on the error signal.

8. The method of claim 1, wherein the adjusting further comprises adjusting the magnitude of the reference voltage of the power supply unit to track the magnitude of the output voltage of the power supply unit when the input voltage is below the first threshold for at least the first time period and the magnitude of the input voltage decreases.

9. A power supply unit for an information handling system, comprising:

a rectifier circuit configured to be coupled to an alternating current power source, the rectifier circuit operable to provide an input voltage based on the alternating current power source; and a control unit configured to monitor a magnitude of the input voltage, to determine a rate of change of the input voltage, and to start a timer when the magnitude of the input voltage drops below a first threshold and when the rate of change of the input voltage is negative, and to determine whether the magnitude of the input voltage is below the first threshold for at least a first time period, wherein the control unit is further configured to adjust a magnitude of a reference voltage of the power supply unit to track a magnitude of an output voltage of the power supply unit when the input voltage is below the first threshold for at least the first time period.

10. The power supply unit of claim 9, wherein the control unit is further configured to control the magnitude of the reference voltage to a substantially similar value as the magnitude of the output voltage.

11. The power supply unit of claim 9, wherein the power supply unit includes a boost converter and the control unit is further configured to control a boost switch of the boost converter to enter or remain in a high impedance state when a value of the timer exceeds the first time period and the magnitude of the input voltage remains below the first threshold.

12. The power supply unit of claim 9, further comprising:

a first comparator configured to limit a current of the power supply unit while the magnitude of the input voltage exceeds the magnitude of the output voltage by at least a second value.

13. The power supply unit of claim 12, wherein the first comparator is further configured to discontinue limiting of the current when the magnitude of the input voltage does not exceed the magnitude of the output voltage by at least the second value.

14. The power supply unit of claim 9, wherein the power supply unit includes a boost converter and the power supply unit further comprises:

a boost switch, wherein the control unit is further configured to control the boost switch to increase the output voltage at a desired rate when the magnitude of the input voltage exceeds the first threshold following the first time period.

15. The power supply unit of claim 9, wherein the power supply unit includes a boost converter and the power supply unit further comprises:

a second comparator configured to compare the magnitude of the reference voltage with the magnitude of the output voltage to provide an error signal, wherein the control unit is further configured to control a duty cycle of a boost switch based on the error signal.

16. The power supply unit of claim 9, wherein the control unit is further configured to adjust the magnitude of the reference voltage to track the magnitude of the output voltage when the input voltage is below the first threshold for at least the first time period.

17. An information handling system, comprising:

a power supply unit, comprising:

a rectifier circuit configured to be coupled to an alternating current power source, the rectifier circuit configured to provide an input voltage based on the alternating current power source; and a control unit configured to monitor a magnitude of the input voltage, to determine a rate of change of the input voltage, to start a timer when the magnitude of the input voltage drops below a first threshold and when the rate of change of the input voltage is negative, and to determine whether the magnitude of the input voltage is below the first threshold for at least a first time period, wherein the control unit is further configured to adjust a magnitude of a reference voltage of the power supply unit to track a magnitude of an output voltage of the power supply unit when the input voltage is below the first threshold for at least the first time period; and an information handling subsystem coupled to and configured to receive power from the power supply unit.

18. The information handling system of claim 17, wherein the power supply unit includes a boost converter and the control unit is further configured to control a boost switch of the boost converter to enter or remain in a high impedance state when a value of the timer exceeds the first time period and the magnitude of the input voltage remains below the first threshold.

19. The information handling system of claim 17, wherein the power supply unit includes a boost converter and the power supply unit further comprises:

a boost switch, wherein the control unit is further configured to control the boost switch to increase the output voltage at a desired rate to initiate a soft start of the boost converter when the magnitude of the input voltage exceeds the first threshold following the first time period.

20. The information handling system of claim 17, wherein the power supply unit includes a boost converter and the power supply unit further comprises:

a comparator configured to compare the magnitude of the reference voltage with the magnitude of the output voltage to provide an error signal, wherein the control unit is further configured to control a duty cycle of a boost switch based on the error signal.

* * * * *